US005914655A

United States Patent [19]

Clifton et al.

[11] Patent Number: 5,914,655

[45] Date of Patent: Jun. 22, 1999

[54] SELF-COMPENSATING INTRUDER DETECTOR SYSTEM

[75] Inventors: Ronald Walter Clifton, Kanata; Douglas Hamilton Taylor, Nepean, both of Canada

[73] Assignee: Senstar-Stellar Corporation, Kanata, Canada

[21] Appl. No.: 08/731,668

[22] Filed: Oct. 17, 1996

[51] Int. Cl.[6] ..... G08B 29/00

[52] U.S. Cl. ..... 340/506; 340/511; 340/517; 340/522; 340/541; 340/565

[58] Field of Search ..... 340/507, 509, 340/511, 517, 521, 522, 541, 565, 567, 588

[56] References Cited

U.S. PATENT DOCUMENTS 5,539,381 7/1996 Johnson ..... 340/584

FOREIGN PATENT DOCUMENTS 2 206 433 1/1989 United Kingdom .

*Primary Examiner*—Jeffery A. Hofsass
*Assistant Examiner*—Daryl C. Pope
*Attorney, Agent, or Firm*—E. E. Pascal; R. A. Wilkes

[57] ABSTRACT

A method of operating an intruder detector system comprising deploying plural intruder sensors in or adjacent a region to be protected, transmitting signals from each sensor to a processor, the signals relating to at least one local environmental ambient condition, processing the signals to determine a common ambient condition associated with the intruder sensors, transmitting a control signal to each of the sensors, and automatically adjusting the sensors in response to the control signal to substantially vary detection parameters thereof.

20 Claims, 7 Drawing Sheets

SELF-COMPENSATING INTRUDER DETECTOR SYSTEM

FIELD OF THE INVENTION

This invention relates to the field of intruder detector systems, and in particular to an intruder detector system which can automatically compensate for ambient changes.

BACKGROUND TO THE INVENTION

Intruder detector systems are used to raise an alarm when an intruder passes into a detection zone. For example, a pair of spaced leaky coaxial cable antennae may be buried around a prison or a military air field. An RF signal applied to one antenna is received by the other antenna. A person entering into the RF field disturbs the field, and this disturbance can be detected by equipment connected to the receiving antenna, which equipment senses phase and/or amplitude changes in the received RF field relative to the transmitted signal.

Such intruder detector systems can be made in several forms, such as those that use a single length of antenna, those that divide the perimeter to be guarded into blocks, etc., and are not limited to use of RF signals. For example, some intruder detector system systems use vibration detectors attached to fences, windows or other structures that can be crossed, etc., separately or in combination with other detectors.

Examples of such intruder detector systems are described in U.S. Pat. Nos. 4,562,428 dated Dec. 31, 1985, 4,994,785 dated Feb. 19, 1991 and 4,887,069 dated Dec. 12, 1991, assigned to Senstar Corporation.

Such intruder detector systems are often affected by rain. For example, rain can increase the moisture content of the soil, changing the dielectric constant of a medium which carries an RF field which is to be detected. Rain and wind can cause vibration detectors to raise an alarm. Intruder detector system systems can be affected by humidity, lightning and electromagnetic interference (EMI), as well as rain and wind. These factors can cause detrimental operation of the intruder detector systems, increasing or decreasing their sensitivity, causing false alarms, etc.

Various techniques have been used to reduce the sensitivity of such systems to the environment, which fall into several categories: (a) detection of the output of each detector of the detector system at a central location and modification of an alarm indication threshold at the central location, with output signals of the sensors which are in excess of the threshold causing an alarm, and (b) variation of an alarm threshold at a local detector by local sensing of a noise factor.

However, neither of these cases provides optimum operation. For example, in the first case the central processor may be required to perform the detection signal processing for all of the individual sensors, which requires an extremely complex centralized algorithm. Further, signals from each sensor must be sent to the central processor, which is inefficient and wastes processing power. Thus if a sensor detects an "out of range" signal biased by the environment, it sends this redundant information to the central processor. In the second case, it is not possible to accurately determine that the sensor signal is caused by a common environmental stimulus, since each detector acts alone. Thus a detector may be purposely desensitized by a determined intruder prior to entry into the detection zone.

For example, in U.S. Pat. No. 4,857,912, plural sensors provide "on" and "off" inputs to a CPU, which weights the inputs from the sensors, averages them, and establishes a threshold above which an intrusion is declared. While this reference teaches that the operating parameters of the CPU can be changed by adjusting the weighting factors under varying conditions for sensors, and can vary the alarm threshold, it does not describe varying the parameters of individual sensors as a result of detecting environmental conditions. "On" and "off" data from the sensors is sent to the CPU, and all weighting is done at that central location, acting on all of the data arriving from each sensor.

In U.S. Pat. No. 4,977,527 the signals returned to a CPU from plural sensors are biased by a sensitivity level stored at the CPU. Each sensor is calibrated by sending a control signal to it and measuring its response. The result, stored at the CPU, is used to evaluate the signals received from the sensors, both as to value and as to history. However this system does not take drift data from plural sensors and use that as a calibration parameter, either to a central processor or to each sensor itself. A linear response curve is generated for each sensor which, when used with sensitivity data, produces a threshold alarm level for each detector, ensuring that each detector responds uniformly to ambient conditions. However, the sensitivity of each sensor is not corrected to compensate for environmental conditions.

In U.S. Pat. No. 5,170,359, plural sensors pass continuous sensor data through transient episode detector processors, which provide transient data to a central memory for processing by a central processor. Each of the transient episode detector processors individually adapt to ignore environmental variation data not of interest, e.g. wind noise, etc.

This system does not vary the transient episode detector processors' environmental data sensitivity generated by other sensors, but only from the data input from an associated sensor. Thus it is not possible to know whether the stimulus is an environmental condition affecting all detectors, or not.

U.S. Pat. No. 5,267,180 describes a fire alarm system in which a local CPU is associated with each fire sensor. Sensor data is transmitted to a central fire receiver after processing in the local CPU. The central fire receiver contains a central CPU which indicates a fire if the data from the local CPUs meet certain rules, which include weightings. The rules are stored centrally and the weightings are applied centrally, to obtain a fire likelihood value. However there is no feedback to the local CPUs of common environment data which desensitizes or biases it against the generation of signals resulting from common environment changes.

U.S. Pat. No. 3,947,834 describes an intruder detector system that includes a sensor which samples external noise parameters such as fence vibration, wind speed, rain rate, etc., and through an AGC desensitizes the system to intruder signals. However this system is comprised of only a single intruder detector processing system which is desensitized.

U.S. Pat. No. 5,465,080 describes plural single (infrared) sensors which produce background signals which are each integrated over time to obtain a "noise" signal, which is compared to a sensor output signal to determine a threshold signal. A sensor signal exceeding the threshold indicates the presence of an intruder. There is no cumulative sensor environmental desensitization.

SUMMARY OF THE INVENTION

The present invention, on the other hand, detects the effects of environmental changes from partly processed data transmitted from each of the sensors to a central location, and as a result derives a control signal or signals which are transmitted back to the sensors, causing them to change their detection sensitivities. This causes environmental factors to be substantially ignored, or at least partly ignored, by the sensors. Because the individual processors can pre-process the detection signal, substantially less data need be sent from each detector to the head end, saving power, local and central processing requirements, etc. This facilitates cost reduction, since less powerful processors can be used, reduces the transmission bandwidth requirement and also reduces the likelihood of generation of false alarm signals.

In the present invention, if one sensor has a large variation from the others, it would indicate a problem, i.e. a fault or an alarm. However similar changes occurring within many sensors (e.g. caused by rain, cold, heating, drift, etc.) results in the central control sending messages to selected ones of the intruder detectors to vary their detection parameters so as to substantially ignore the changes.

In accordance with an embodiment of the invention, a method of operating an intruder detector system is comprised of deploying plural intruder sensors in or adjacent a region to be protected, transmitting signals from each sensor to a processor, the signals relating to at least one local environmental ambient condition, processing the signals to determine a common ambient condition associated with the intruder sensors, transmitting a control signal to each of the sensors, and automatically adjusting the sensors in response to the control signal to substantially vary the detection parameters thereof.

In accordance with another embodiment, a method of operating an intruder detector is comprised of deploying plural intruder sensors adjacent or in a region to be protected, each of the sensors processing a detected ambient condition by means of a detection algorithm, processing values of similar parameters of the detection algorithms to determine common processing parameter values, and using the common parameter values by each of the detection algorithms in each sensor for subsequent processing of an ambient condition.

BRIEF INTRODUCTION TO THE DRAWINGS

A better understanding of the invention will be obtained by considering the detailed description below, with reference to the following drawings, in which.

DETAILED DESCRIPTION OF PREFERRED EMBODIMENT

The description below will be directed to an example of an RF intruder detector system which uses buried leaky coaxial cables as the sensor elements (sensors). However a person skilled in the art will recognize that the principles of the invention can be used additionally with RF unburied systems, and/or with other detectors such as vibration sensors, for example.

Figure 1:
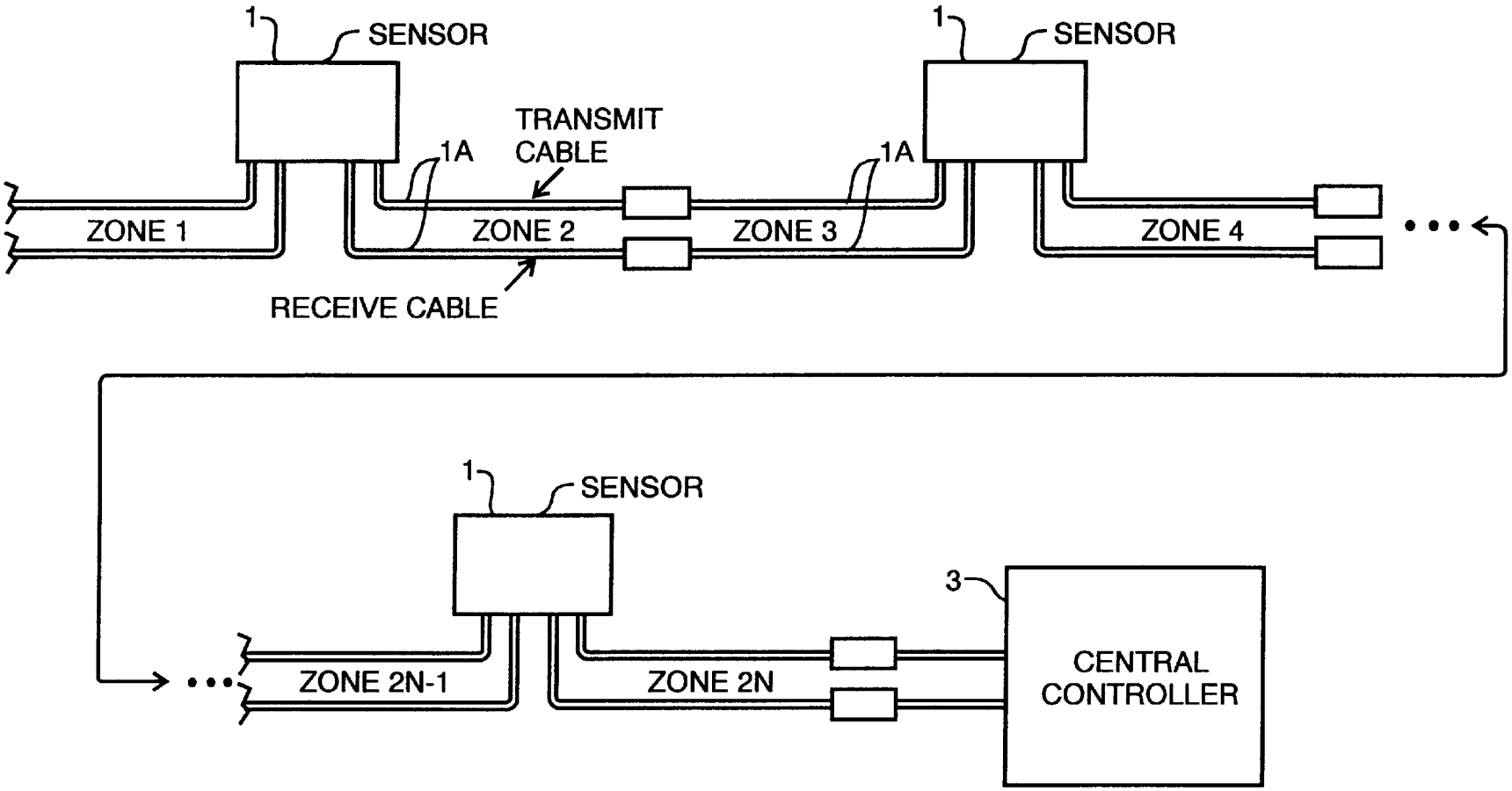
FIG. 1 is a block diagram illustrating the system in general form.

FIG. 1 illustrates a general preferred embodiment of the invention. Pairs of sensor cables 1A, arranged to protect zones, e.g. zone 1, zone 2, . . . zone 2N, are connected to sensor electronic subsystems, which will be referred to herein generally as sensors 1, since the subsystems both apply a signal to one cable of the zone, detect the signal received from the other cable, and process the detected signal. The sensors are in communication with a central controller 3 by some data communication means which allows two way communication between the central controller and each of the sensors. Such two way communication means is well known, such as multi-drop connection via the sensor cables themselves, passing from one zone to the other via RF trap circuits.

Figure 2:
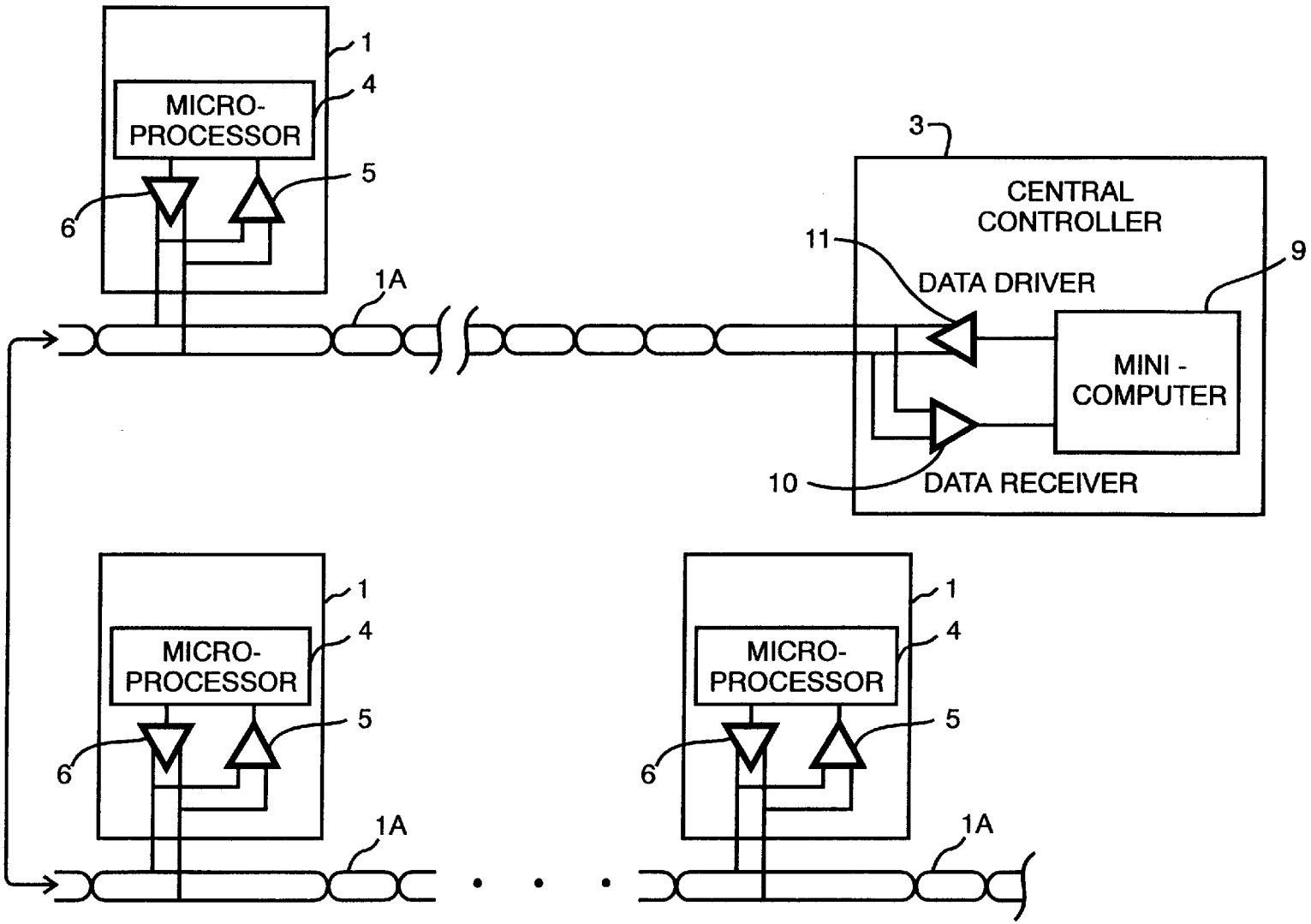
FIG. 2 is a block diagram illustrating the system in more detail.

The structures relating to data communication of the sensors 1 and central processor 3 are shown in more detail in FIG. 2. Each sensor includes a microprocessor 4 which is coupled to the output of a receive amplifier 5 and to the input of a transmit amplifier 6. The amplifiers are connected to the data communication means 5 which, for example, could be the sensor cables LA themselves (assuming a suitable RF trap between cables are used).

In each zone, in a successful prototype of the invention, a 40.68 MHz signal was transmitted down the transmit leaky cable, some of which is coupled continuously to the receive leaky cable. An intruder in the proximity of the cables causes a change in the coupling amplitude or phase which is detected by the sensor 1.

The central controller 3 is comprised of a minicomputer 9 or personal computer which is coupled to the output of a receive amplifier 10 and to the input of a transmit amplifier 11. The amplifiers 10 and 11 are connected to the cables 1A.

Means of communication between the sensors and central controller 3 other than the cables described can be used, and the invention is not restricted to use of the sensor cables for communication.

Amplifiers 5, 6, 10 and 11 are comprised also of data drivers and receivers, which can transmit and receive data to and from the sensors and central controller.

Figure 3:
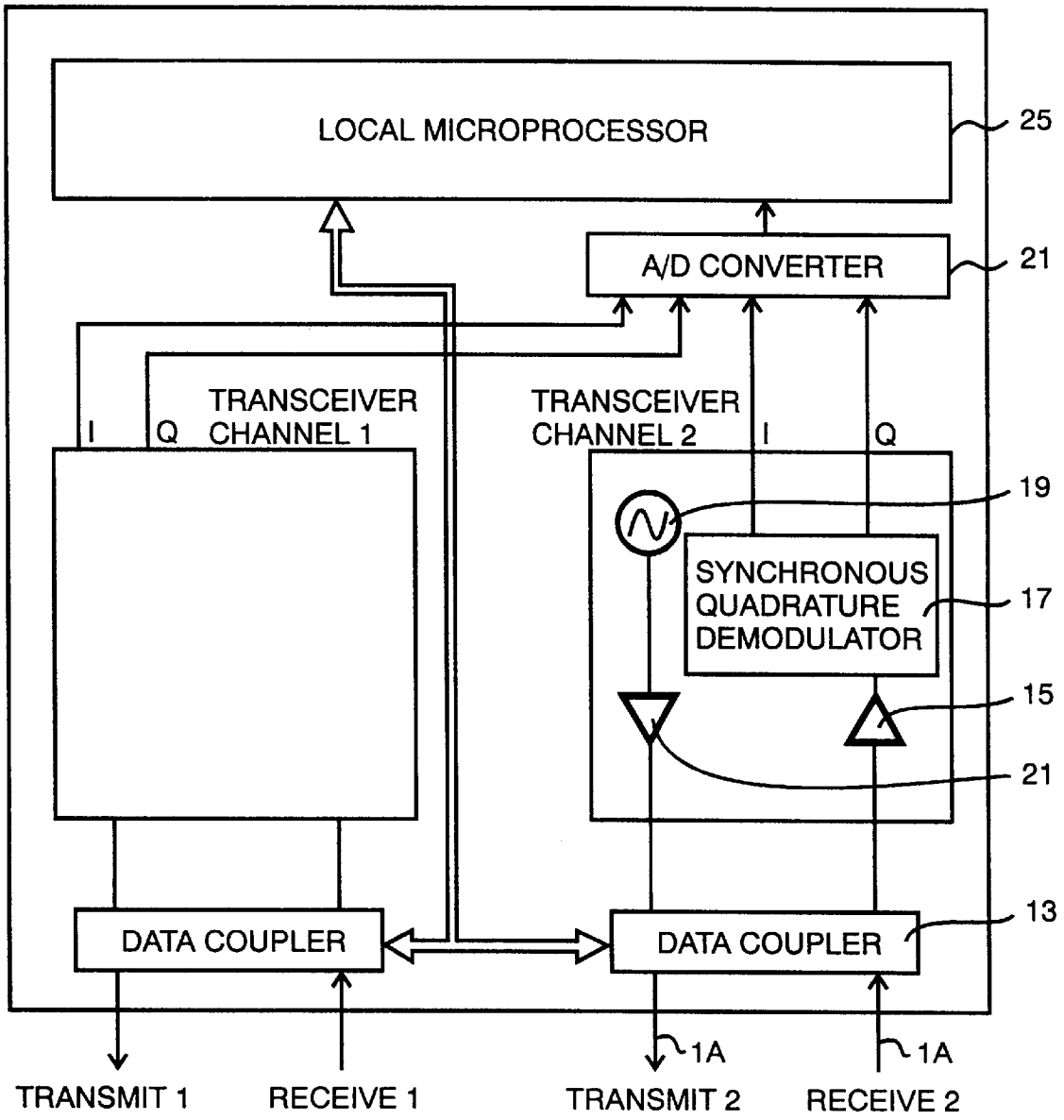
FIG. 3 is a block diagram illustrating a sensor in still more detail.

FIG. 3 illustrates a sensor in more detail. Because there are two zones connected to each sensor in the illustrated example system, two channels (Channel 1 and Channel 2, one for each of the two zones) are shown. However, only one channel will be described, since the principles are equally applicable to each of the two channels, and to each of the sensors.

A data coupler 13, which can be comprised of the receive and transmit amplifiers 5 and 6, receives the RF signal and applies it via an amplifier 15 to a synchronous quadrature demodulator 17. An RF signal generator 19 supplies the RF signal, e.g. 40.68 MHz, which is applied through amplifier 21 and data coupler 13 to the transmit cable 1A, and is also applied to demodulator 17. The result of the demodulation are in-phase (I) and quadrature shifted (Q) signals that are proportional to the signal received on the receive cable.

The I and Q signals are applied via an analog to digital converter (A/D) 21, in which they are digitized, to a local microprocessor 25.

The digitized I and Q signals are processed in the microprocessor 25 by a detection algorithm, as will be described below, and which includes a digital high pass filter. This filter ignores constant or slow moving components to the I and Q signals. The filtered I and Q signals are then combined into a magnitude signal which is compared to a detection threshold.

If the threshold is exceeded, an alarm is declared and is transmitted to the central control. The threshold is preferably set during installation of the system, and can vary from sensor to sensor and from zone to zone due to varying sensitivities to intruders caused by varying soil conditions.

Figure 4:
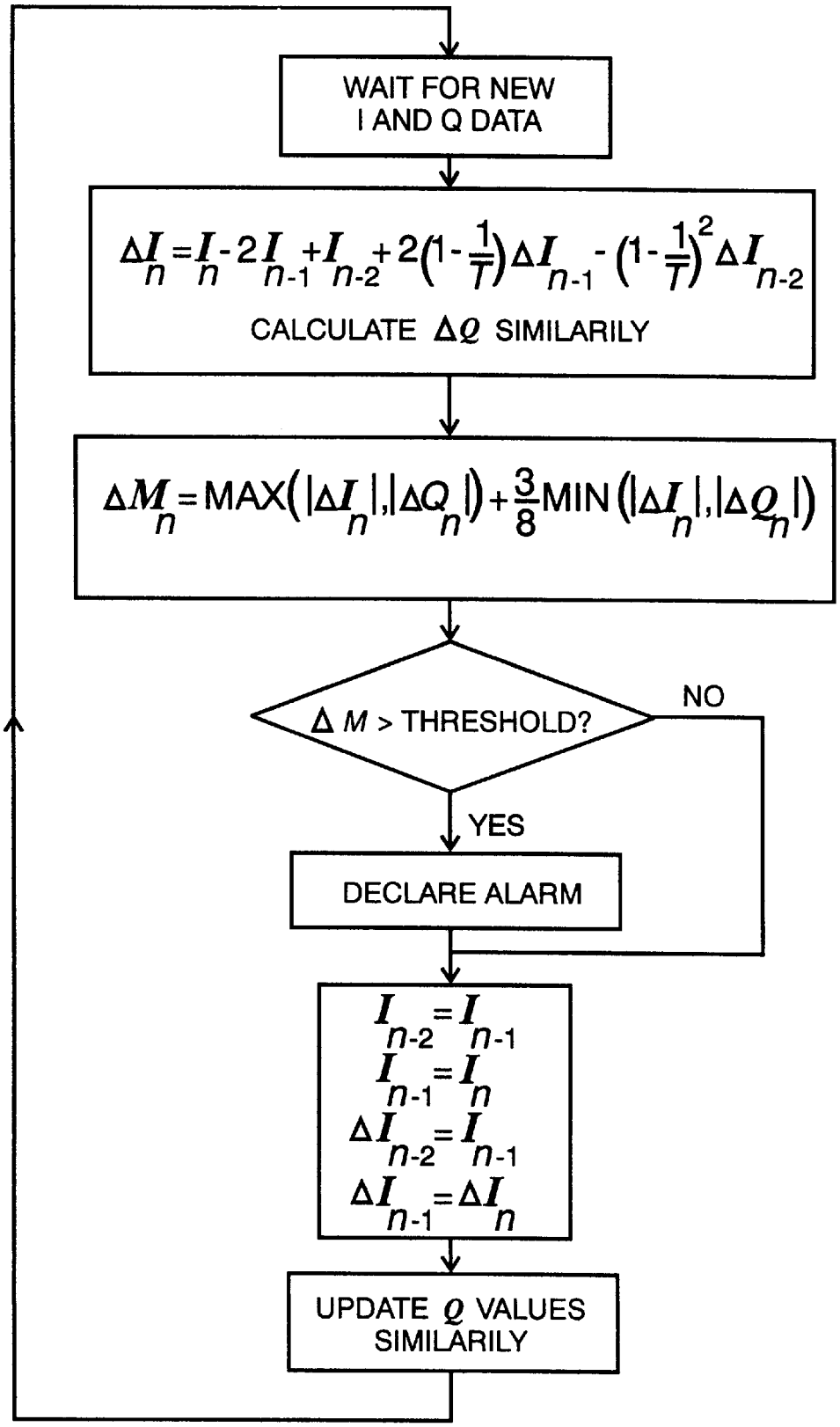
FIG. 4 is a flow chart of a processing algorithm used in each of the sensors.

A flow chart of the algorithm is shown in FIG. 4. The I signal is processed through the filter $$\Delta I_n = I_n - 2I_{n-1} + I_{n-2} + 2\left(1 - \frac{1}{T}\right)\Delta I_{n-1} - \left(1 - \frac{1}{T}\right)^2 \Delta I_{n-2} \quad (1)$$

and the Q signal is processed through the similar filter $$\Delta Q_n = Q_n - 2Q_{n-1} + Q_{n-2} + 2\left(1 - \frac{1}{T}\right)\Delta Q_{n-1} - \left(1 - \frac{1}{T}\right)^2 \Delta Q_{n-2} \quad (2)$$

In the above formulae, the value $I_n$ is the current sample of the I signal, and the value $Q_n$ is the current sample of the Q signal. The value T is related to the high pass filter cut-off frequency by well known formulae which are in the literature on digital signal processing.

In a successful prototype of the invention, the value T was initially set at 512, which resulted in a cutoff frequency of 0.005 Hz.

The ΔI and ΔQ signals resulting from the above process steps are then combined to form a magnitude signal $\Delta M_n$, in the next step, as shown in FIG. 4, in accordance with the algorithm $$\Delta M_n = \max(|\Delta I_n|, |\Delta Q_n|) + \frac{3}{8}\min(|\Delta I_n|, |\Delta Q_n|)$$

The value ΔM is then compared with the aforenoted alarm threshold. If it exceeds the threshold, an alarm is declared, which can be either locally stored for later transmission if desired after further processing, or can be immediately transmitted to the central controller.

If the value ΔM does not exceed the threshold, the next sampled values of I and Q are updated, and are processed through the algorithms (1) and (2) noted above. The process continuously repeats.

The I and Q signals preferably are processed at a rate of 17.5 times per second, which is fast enough to detect the fastest human intruder. For each individual sensor, the magnitude data ΔM should be sent in digital form to the central controller. However, it can be sent at a rate of only 1 sample per second. This greatly reduces the load on the data communications network between the sensors and the central controller from prior art systems.

The microprocessor 25 should retain a list of detection algorithm parameters including the high pass filter time constant T and the magnitude ΔM in a series of random access memory (RAM) locations (not shown as it is considered to be part of microprocessor 25), where the detection algorithm can access them. The magnitude ΔM should be retrieved, and a communications program stored in the RAM should send a message containing these values and a current time index to the central controller preferably once each second.

The values of ΔM, should be construed as the environmental ambient condition transmitted to the central controller.

The central controller, which can be a personal type computer, receiving ΔM from the sensors, operates an environmental flag routine, for example a rain flag. When it detects rain (as determined from the data transmitted to it by plural or all detectors), i.e. it finds that the rain condition has changed from false to true, it transmits a message containing an appropriate set of detection algorithm parameters to each of the sensors that have provided the environmentally common parameters. Upon the sensors receiving the parameters from the central controller, each of the detectors change their parameters, in a direction to substantially ignore the sensor signals caused by the rain.

The parameters transmitted to each of the sensors include the filter time constant T, which will change only during the rain (or other environment) condition. Preferably the value that T should change to is T/4, but can be some other value that conditions suggest.

When the algorithm at the central controller determines that the rain condition has changed from true to false, it transmits a message containing the nominal detection algorithm parameters to each of the sensors.

Figure 5:
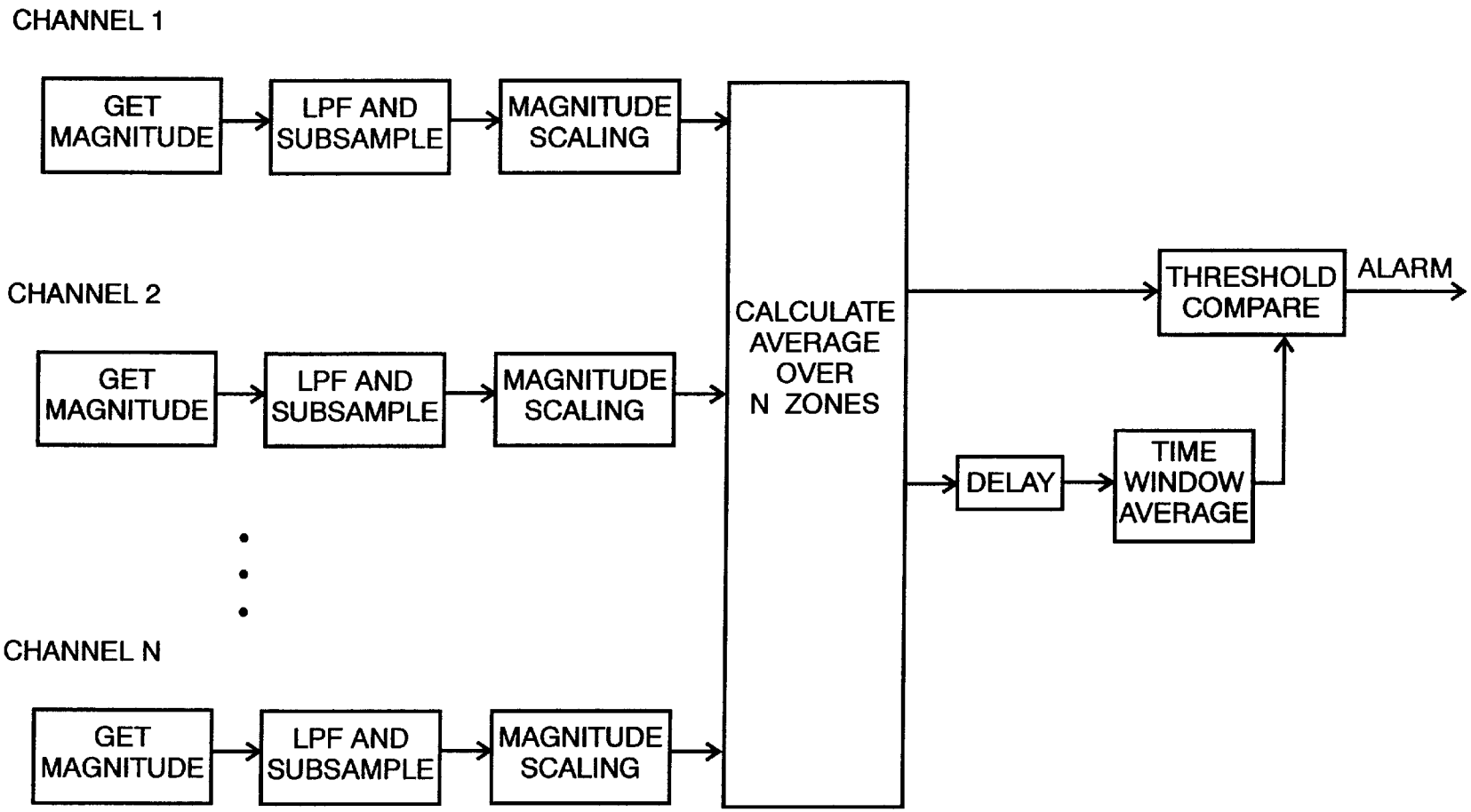
FIG. 5 is a flow chart of a processing algorithm used in the central controller.

FIG. 5 illustrates in block form an algorithm operated by the central processor which can detect the condition of rain (or some other environmental condition). Data from each of the sensors is input to respective channels Channel 1, Channel 2 . . . Channel N. As each of the channels is similar, processing using only one will be described.

The data arriving from a sensor each second is low pass filtered, and is subsampled. In a successful prototype of the invention, a 21 stage digital FIR filter was used, and a subsample factor of 8. However, other values can be used, and a subsample rate of 2 or 4, for example, may be used. At the subsample factor of 8, the data emerging from this processing step is at a rate of 1 sample every 8 seconds for each channel (each sensor zone).

The magnitude data is then normalized. Because the individual zone cables may be buried in different types of soil, the response to rain may be of different magnitude in different zones. However, the rain response of the individual zones will be proportional to the intruder response. Therefore the intruder detection threshold used by each individual zone can be used as a basis for the normalization.

A scaling technique that can be used is to divide the filtered, subsampled magnitude value by the target detection threshold. In a preferred embodiment, the central controller should know the individual zone thresholds by means of the communication network with the sensors, but could alternatively be entered for storage at the central control by a technician on installation of the system.

Alternatively, other scaling techniques can be used, such as being based on a combination of the threshold value and a lookup table, etc.

Figure 6:
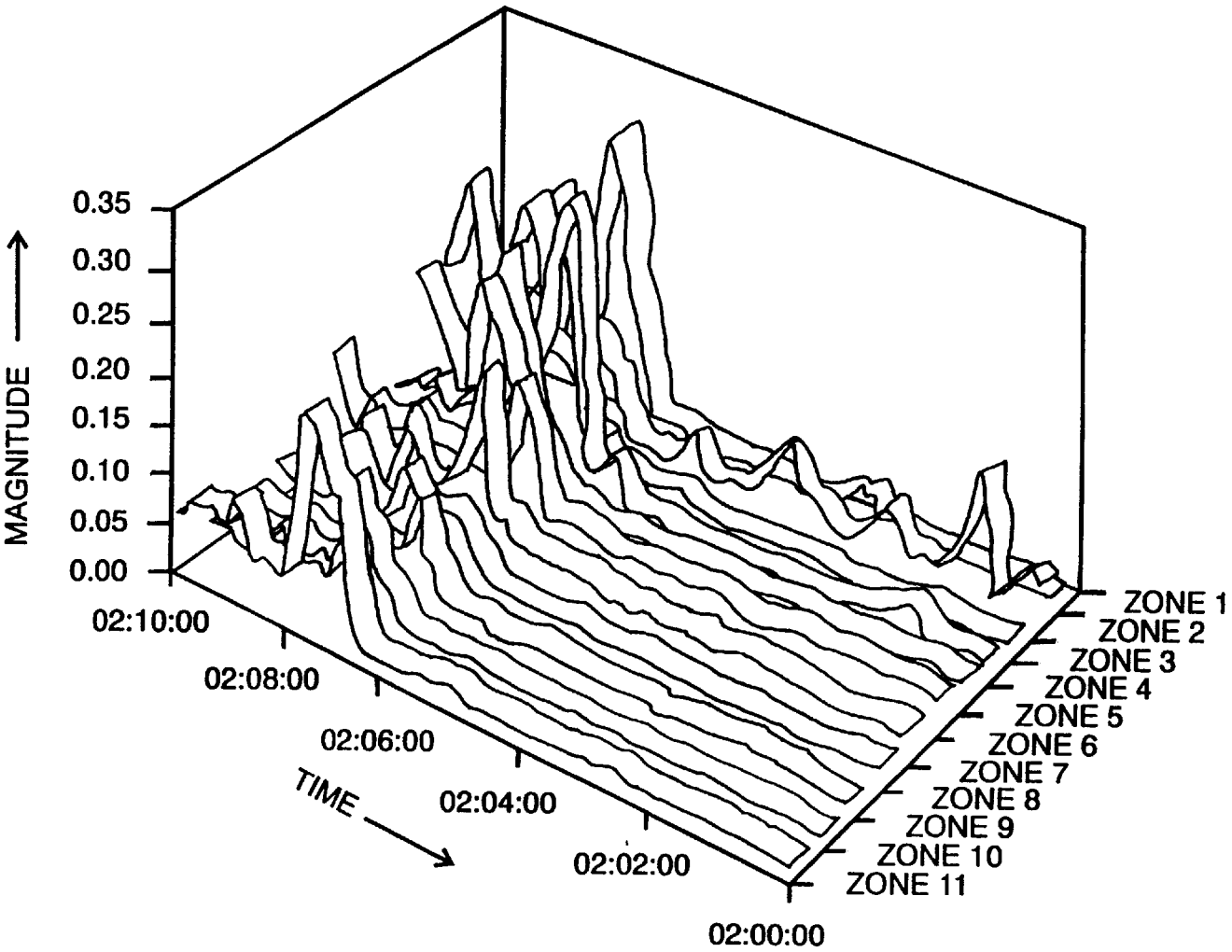
FIG. 6 is a graph of a typical response of multiple sensor zones at the onset of rain.

Turning to FIG. 6, a graph of a typical response of multiple sensor zones at the onset of rain is shown. The graph plots the filtered, subsampled, normalized magnitude signals of each of 11 zones, in the central processor, as a function of time. It may be seen from the graph that the rain starts where the magnitude value for most of the zones rises simultaneously. A slow moving intruder would cause a similar change in only one or at most two zones.

It is preferred that the central processor should use a constant false alarm rate (CFAR) method to identify a simultaneous change in the magnitude signal from several individual zones similar to that shown in FIG. 6, and should infer a rain condition whenever this condition is met. The detection threshold should be set based on an average of the subsampled, scaled, magnitude values over all of the zones and over a period of time $T_{CFAR}$. The period of time is preferably adjustable by a technician, but can take a default value of 2 minutes. The CFAR threshold should be calculated as a CFAR factor, which should also be adjustable, but can take a default value of 2, times the average value.

Rain should be declared when two conditions are met: (a) the current average over the individual zones of the subsampled scaled magnitude should be greater than the CFAR threshold, and (b) the values of subsampled scaled magnitude for n or more zones should be over the CFAR threshold. The value of the parameter n should also be adjustable, with a default value preferably equal to the total number of zones divided by three, but not less than three zones.

Figure 7:
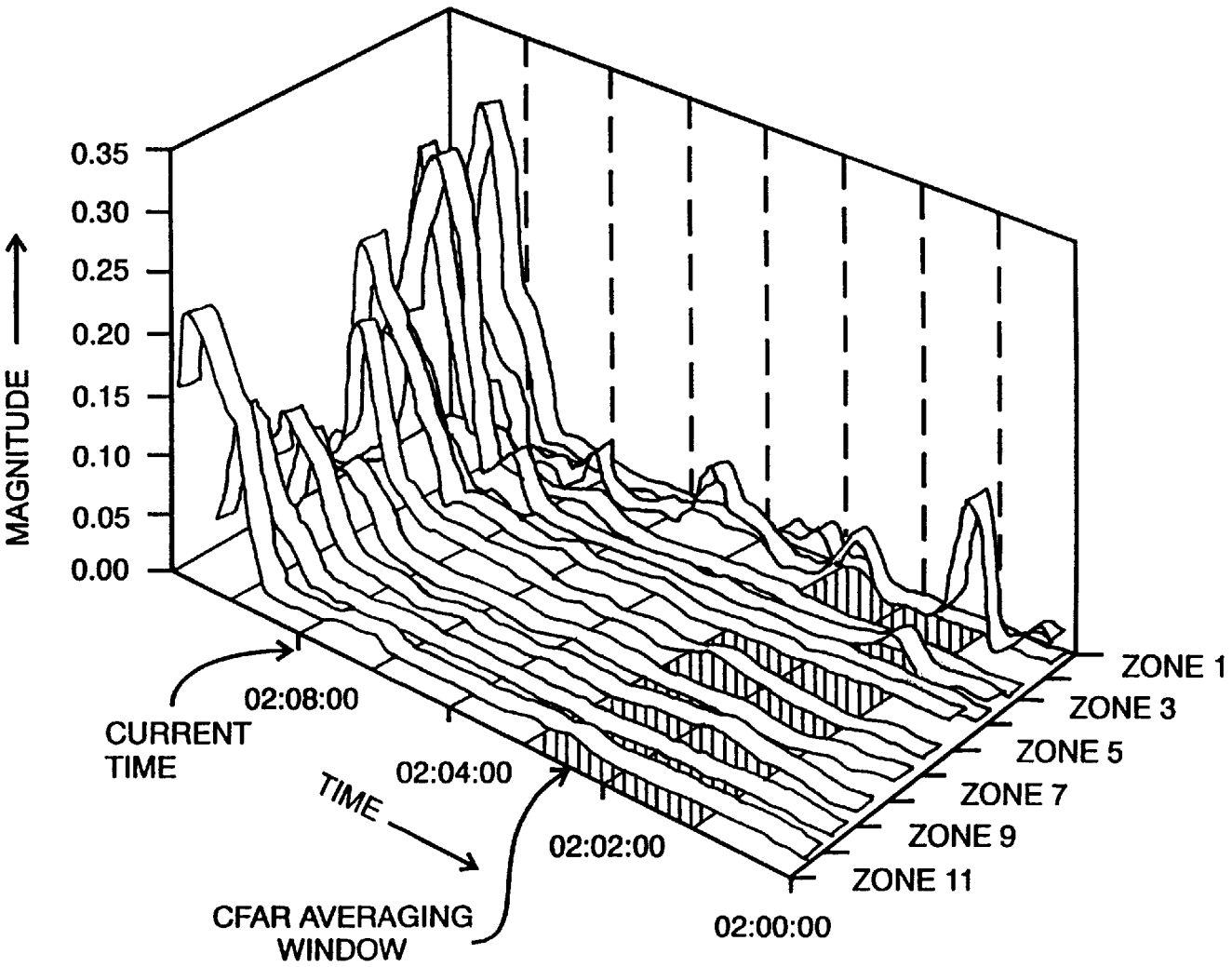
FIG. 7 is a graph of response of multiple sensor zones during processing.

FIG. 7 illustrates the magnitude values over time, as in FIG. 6, but showing the current time and the CFAR averaging window. As may be seen, the time window over which the CFAR average is calculated should lag the current time value. This ensures that gradually rising magnitude values, as may occur when rain starts lightly, then increases in intensity, do not force the CFAR threshold up gradually so that the rain condition is never fulfilled. The lag between the CFAR time window and the current value is also preferably an adjustable parameter, but can have a default value of three minutes.

When a rain condition is declared, the current value of the CFAR average should be saved. Then the time window over which the CFAR average is calculated should be moved so that the start of the time window coincides with the start of the rain alarm. The rain condition is held true for $T_{CFAR}$ minutes, until a new value of CFAR average, calculated entirely during the rain period, is available.

Subsequently, the current CFAR average should be compared with the saved CFAR average from before the rain, times a rain off CFAR factor, and the rain condition should be declared over, when the former falls below the latter. The rain off CFAR factor is preferably an adjustable parameter, with a default value that can be 1.2.

To reduce processing load, the CFAR average need not be recalculated every time new values of the subsampled, normalized magnitude become available. In a successful embodiment, the CFAR factor was updated every $T_{CFAR}/2$ minutes.

It will be recognized that some zones in an installation may not be affected by rain (or some other environmental factor), or are affected in an anomalous manner. Therefore certain zones can be excluded from the algorithm, and the parameters of which can be excluded from adjustment from the central processor.

The term plural sensors in this specification thus means either all sensors in a system, or only some sensors of the system.

The term ambient condition that is detected is intended to be construed to mean parameter values resulting from anything detected by a sensor, whether it results from rain, heat, some other environment condition, from the presence of an actual intruder, or the presence of another body such as an animal, a moving body such as an automobile, shaking of a fence, etc.

While the above description has been directed to the environmental condition rainfall, the techniques are similarly applicable to other conditions. For example, when high winds shake a chain link fence located near a detection zone, it can cause a response in the intruder detector system which can sometimes can be mistaken for an intruder. However, this effect will be apparent in several zones, often localized to the windward side of a protected area. The knowledge of which group of zones was affected by an increase in the magnitude value combined with a learned knowledge of how the wind affected the individual zones for a particular installation can be used to detect wind and modify the individual zone detection algorithms in the affected sensors, to eliminate nuisance alarms due to wind.

It will also be recognized that the process described herein can be applied to other types of intruder detector sensors which are also affected by similar environmental conditions, for example passive infrared detectors, microwave detectors, sound detectors (microphones), seismic detectors, etc. Parameters of the local detection algorithm can be modified upon receipt of a signal from the central controller with the goal of reducing nuisance alarm susceptibility of plural sensors to the environmental factor.

Auxiliary inputs such as weather data can also be used by the central controller to influence the modified algorithm parameters which are sent to the individual sensors. For example, in the case of rain, an additional input such as wind direction or a rain gauge can be employed to affect the rain response control, so that different zones will respond first.

The invention thus results in each sensor transmitting the magnitude signal at a rate which is reduced relative to prior art systems, which reduces the load on the communication network. To reduce the load still further, signal compression techniques can be used.

Responses to multiple external stimuli such as EMI and rain, or to adapt the zones in a non-binary fashion, can be combined by using such techniques as fuzzy logic, neural networks etc. For example, the central control may send various sets of modified algorithm parameters to the individual units depending on the degree of rain intensity that it infers.

A person understanding this invention may now conceive of alternative structures and embodiments or variations of the above. All those which fall within the scope of the claims appended hereto are considered to be part of the present invention.

We claim:

1. A method of operating an intruder detector system comprising:

(a) deploying plural intruder sensors in or adjacent a region to be protected, (b) transmitting signals from each sensor to a processor, said signals relating to at least one local environmental ambient condition, (c) processing said signals to determine a common ambient condition associated with each respective one of said intruder sensors, (d) automatically transmitting a control signal resulting from the determination of the common ambient condition to each of said sensors, and (e) automatically adjusting each of said sensors in response to said control signal to substantially vary detection parameters thereof.

2. A method as defined in claim 1, in which the adjusting step decreases the sensitivity of the sensors to an environmental condition within a controlled range.

3. A method of operating an intruder detector comprising:

(a) deploying plural intruder sensors adjacent or in a region to be protected, (b) each of the sensors processing a detected ambient condition by means of a detection algorithm, (c) processing values of similar parameters of said detection algorithms to determine common processing parameter values, and (d) using the determined common parameter values by the detection algorithm in each sensor modified in accordance with the determined common parameter values for subsequent processing of an ambient condition.

4. A method as defined in claim 3 in which the processing step includes filtering a signal related to the ambient condition through a filter and applying resulting values to an amplitude sensor having a detection threshold, at least one of the resulting values and the detection threshold being controlled by the common parameter values.

5. A method as defined in claim 4 including emitting a radio frequency signal, receiving said radio signal and using the received radio signal as the detected ambient condition.

6. A method as defined in claim 4 including transmitting said values of similar parameters to a central processor for said processing to determine said common parameter values.

7. A method as defined in claim 6 in which the received signal is comprised of in-phase (I) and quadrature shifted (Q) signals, processing each of said I and Q signals separately through the filter, combining filtered representations of the I and Q signal to determine a magnitude value, comparing the magnitude value to said detection threshold, and indicating a local alarm in the event the detection threshold is exceeded.

8. A method as defined in claim 7 in which each filter is a high pass filter which includes a filter time constant (T), each sensor transmitting filtered magnitude values to a central processor at predetermined times for processing, determining at said central processor a new time constant value $T_n$ from plural said transmitted filtered magnitude values, transmitting a message related to the value $T_n$ to each of the sensors, and each of the sensors modifying its value T in accordance with the message.

9. A method as defined in claim 8 in which the message contains the value $T_n$, and changing the value T in each of the sensors to $T_n$.

10. A method as defined in claim 8 including determining at the central processor said ambient conditions of at least a predetermined number of said plural intruder sensors which are in excess of a predetermined threshold over a certain time interval, and following said determination, determining said new time constant $T_n$ and transmitting said message.

11. A method as defined in claim 10 including subsequently determining at the central processor said ambient conditions of said at least predetermined number of plural intruder sensors which are below said predetermined threshold over a subsequent time interval, and following said latter determination, determining another new time constant value $T_n$ and transmitting said message.

12. A method as defined in claim 10 in which said predetermined threshold is established by averaging said ambient conditions over a period of time.

13. A method as defined in claim 10 in which said predetermined threshold is established by subsampling said magnitude values, normalizing the subsampled magnitude values and averaging the normalized subsampled magnitude values of at least a predetermined number of said sensors over a period of time.

14. A method as defined in claim 12 in which said at least predetermined number of intruder sensors is not less than three.

15. A method as defined in claim 12 in which the averaging step is conducted over an adjustable time window which lags a current time by an adjustable predetermined interval.

16. A method as defined in claim 8 including determining at the central processor said ambient conditions of at least a predetermined number of said plural intruder sensors which are in excess of a a predetermined threshold over a certain time interval, and following said determination, determining said new time constant $T_n$ and transmitting said message.

17. A method as defined in claim 16 including subsequently determining at the central processor said ambient conditions of said at least predetermined number of plural intruder sensors which are below said predetermined threshold over a subsequent time interval, and following said latter determination, determining another new time constant value $T_n$ and transmitting said message.

18. A method as defined in claim 16 in which said predetermined threshold is established by averaging said ambient conditions over a period of time.

19. A method as defined in claim 18 in which said predetermined threshold is established by subsampling said magnitude values, normalizing the subsampled magnitude values and averaging the normalized subsampled magnitude values of at least a predetermined number of said sensors over a period of time.

20. A method as defined in claim 18 in which said at least predetermined number of intruder sensors is not less than three.

* * * * *